US010106977B2

(12) United States Patent
Åsberg

(10) Patent No.: US 10,106,977 B2
(45) Date of Patent: Oct. 23, 2018

(54) METHOD, ARRANGEMENT, LID AND ADAPTER FOR DRYING A WATER DAMAGED FLOOR

(71) Applicant: Reddo Floor Solutions AB, Stockholm (SE)

(72) Inventor: Johan Åsberg, Mollösund (SE)

(73) Assignee: Reddo Floor Solutions AB, Stockholm (SE)

( * ) Notice: Subject to any disclaimer, the term of this patent is extended or adjusted under 35 U.S.C. 154(b) by 0 days.

(21) Appl. No.: 15/557,169

(22) PCT Filed: Mar. 9, 2016

(86) PCT No.: PCT/SE2016/000010
§ 371 (c)(1),
(2) Date: Sep. 11, 2017

(87) PCT Pub. No.: WO2016/144229
PCT Pub. Date: Sep. 15, 2016

(65) Prior Publication Data

US 2018/0106033 A1 Apr. 19, 2018

(30) Foreign Application Priority Data

Mar. 12, 2015 (SE) ..... 1530033

(51) Int. Cl.
*E04B 1/70* (2006.01)
*E04G 23/02* (2006.01)
*F26B 9/02* (2006.01)

(52) U.S. Cl.
CPC ..... *E04B 1/7092* (2013.01); *E04G 23/0285* (2013.01); *E04B 1/7069* (2013.01); *E04B 1/7076* (2013.01); *F26B 9/02* (2013.01)

(58) Field of Classification Search
CPC .... E04B 1/7092; E04B 1/7069; E04B 1/7076; E04G 23/0285; F26B 9/02
See application file for complete search history.

(56) References Cited

U.S. PATENT DOCUMENTS 3,558,384 A * 1/1971 Ronning ..... E04G 23/0285 156/98
3,558,385 A * 1/1971 Ronning ..... B26D 1/445 156/98

(Continued)

FOREIGN PATENT DOCUMENTS

DE 19716230 A1 * 10/1998 ..... E04B 1/7092
DE 10 2004 033 209 A1 2/2006

(Continued)

OTHER PUBLICATIONS

International Search Report and Written Opinion for corresponding Patent Application No. PCT/SE2016/000010 dated May 12, 2016.

*Primary Examiner* — Babajide A Demuren
(74) *Attorney, Agent, or Firm* — Renner, Otto, Boisselle and Sklar, LLP

(57) ABSTRACT

A water damaged floor (10) is dried by forming an opening (18) in a flooring (14) of the floor and creating and forcing an airflow from a surrounding space (28) through the opening (18) into a ventilating space between the flooring (14) and a subfloor (22). According to the invention, an end portion of the flooring (14) is elevated from the subfloor (22) for creating said ventilating space and for creating an air passage (27) between the ventilating space and the surrounding space (28) at an edge of the flooring (14).

17 Claims, 4 Drawing Sheets

(56) References Cited

U.S. PATENT DOCUMENTS

| | | | | | |
|---|---|---|---|---|---|
| 3,558,386 | A * | 1/1971 | Ronning | A47G 27/0487 | 156/98 |
| 3,697,358 | A * | 10/1972 | Ronning | A47G 27/0487 | 156/514 |
| 4,261,759 | A | 4/1981 | Cawley | | |
| 5,155,924 | A | 10/1992 | Smith | | |
| 5,950,326 | A * | 9/1999 | Scott | E04D 13/17 | 34/104 |
| 7,882,668 | B2 * | 2/2011 | Pedersen | E04B 1/7092 | 454/284 |
| 8,297,015 | B2 * | 10/2012 | Martin | E04B 1/7092 | 52/302.1 |
| 2005/0257394 | A1 * | 11/2005 | Claesson | E04B 1/7092 | 34/92 |
| 2014/0033633 | A1 | 2/2014 | Kell | | |

FOREIGN PATENT DOCUMENTS

| | | | | |
|---|---|---|---|---|
| DE | 102012007273 | A1 * | 9/2013 | E04B 1/7092 |
| WO | 9423142 | A1 | 10/1994 | |
| WO | WO-9621834 | A1 * | 7/1996 | E04B 1/7092 |
| WO | 03016647 | A1 | 2/2003 | |

* cited by examiner

METHOD, ARRANGEMENT, LID AND ADAPTER FOR DRYING A WATER DAMAGED FLOOR

This application is a national phase of International Application No. PCT/SE2016/000010 filed Mar. 9, 2016 and published in the English language, which claims priority to Swedish Patent Application No. 1530033-8 filed Mar. 12, 2015, which are hereby incorporated herein by reference.

TECHNICAL AREA

This invention relates to a method of drying a water damaged floor, comprising forming an opening in a flooring of the floor and creating and forcing an airflow from a surrounding space through the opening into a ventilating space between the flooring and a subfloor. The invention also relates to an arrangement for performing the method as well as a lid and an adapter for use in the arrangement.

BACKGROUND

Prior art methods and arrangements of this category can be effectively used only in cases where there already is an existing ventilating space such as in a wooden beam subfloor structure underneath the flooring. When the flooring is installed on a flat subfloor face, such as on a concrete subfloor or wooden subfloor, there is no available ventilating space underneath the flooring. In such cases the water damaged flooring has to be removed before a drying operation and replaced after finishing the drying operation. It would therefore be desirable to conceive a method and an arrangement capable of drying also floors absent of existing ventilating spaces.

DISCLOSURE OF THE INVENTION

An object of the invention is to provide a method, arrangement, lid and adapter that is particularly but not exclusively adapted for drying floors not having an existing ventilating space.

Another object is to provide a method, arrangement, lid and adapter that is particularly but not exclusively adapted for drying floating floors, for example parquet floors.

Still another object is to provide a method, arrangement and adapter where the flooring may not need to be removed and replaced by a new flooring after a drying operation.

In an aspect of the invention, the above identified method of drying a water damaged floor further comprises elevating an end portion of the flooring from the subfloor for creating said ventilating space and for creating an air passage between the ventilating space and the surrounding space at an edge of the flooring.

By elevating the end portion, the ventilating space required for drying can be easily created also in floor structures where the flooring is placed directly above a flat subfloor top surface, such as in the common case of a concrete subfloor or a wooden subfloor or similar. A side effect of elevating the end portion is also the creation of the air passage that is vital to have the airflow circulating through ventilating space, surrounding space and an arrangement for conditioning the airflow and forcing it into circulation.

The required elevation for creating a sufficient ventilation space is only a few millimeters and will therefore not cause any mechanical damage to the flooring. When the drying operation is finished, the flooring can be lowered to its original state, resting on the subfloor, and in most cases with no need to be replaced.

The opening can be formed in the end portion of the flooring. Thereby, the perimeter portions of the opening can be used for engagement by an elevating device adapted for lifting the flooring.

It is, however, conceivable to lift the end portion of the flooring at another area than the opening at a distance from an edge of the flooring. By elevating the flooring at the end portion, the ventilating space will have a wedge-shaped cross section, the extent of which can be easily controlled by the amount of lifting. Theoretically, it would be possible to lift the flooring at a near midpoint of the floor and still obtain the wedge-shaped cross section having an air passage at an end of the flooring.

Specifically, the flooring is lifted by pushing the flooring away from the subfloor. In that case, there may be no need for any external lifting devices but the flooring can be lifted by a force acting through said opening and between the flooring and the subfloor.

When the flooring has a relatively stiff surface layer and a relatively flexible subsurface layer, the subsurface layer can be glued to the surface layer intermittently around a perimeter of said opening for allowing airflow also into a space between the surface layer and the subsurface layer.

After completion of the drying operation the opening can be enlarged and the resulting enlarged opening can be closed by a correspondingly shaped lid made of a suitable flooring material. The enlarged opening can remove any remaining marks in the flooring such as screw holes produced in the drying operation.

Alternatively, a top portion of the opening can be enlarged after a completion of the drying operation, whereby the resulting enlarged top opening also can be closed by a correspondingly shaped piece or element, such as a piece of veneer, to obtain a higher finish.

When necessary, the forced airflow is typically also conditioned in a suitable manner.

An arrangement for performing a method according to the invention comprises means for forcing the airflow, tubing for communicating the airflow between the means for forcing the airflow and the opening, an adapter for connecting the tubing to the opening, and an elevating device for lifting the end portion of the flooring from the subfloor.

While in certain cases an unconditioned air may be used, the arrangement may further comprise means, such as a heater, dehumidifier or other means for conditioning the airflow to be capable of drying the floor. Moreover, the airflow does not need to be forced by overpressure but may likewise be forced by suction or vacuum.

The arrangement may also comprise a manifold between the means for forcing the airflow and the opening. Then it will be possible to dry a larger area of the floor by forming a plurality of openings and using a plurality of adapters.

In one embodiment the elevating device comprises a pushing mechanism to be inserted in said opening for engagement with the flooring and the subfloor.

The pushing mechanism can be integrated with the adapter.

While other pushing mechanisms are conceivable, in one embodiment of the invention the pushing mechanism is a screw mechanism.

The invention also concerns a lid to be used for closing an opening used in a method or an arrangement of any of claims.

An adapter to be used in the arrangement comprises a base having a bore through the base, means in the base for connection of an end portion of said tubing to the bore, a pushing mechanism, and means for attaching the base to said flooring.

The adapter may further comprise a rod having a universal joint and means for releasably connecting a distal end of the rod to a screw or handle in the pushing mechanism. Thereby, an operator may be capable of operating the pushing mechanism by rotating a proximal end of the rod at a distance from the opening in the flooring, so as not to unnecessarily load the flooring in the vicinity of the opening by operator's bodyweight.

Other features and advantages of the invention may be apparent in the following detailed description and the appended claims.

DETAILED DESCRIPTION OF EXEMPLARY EMBODIMENTS

Figure 1:
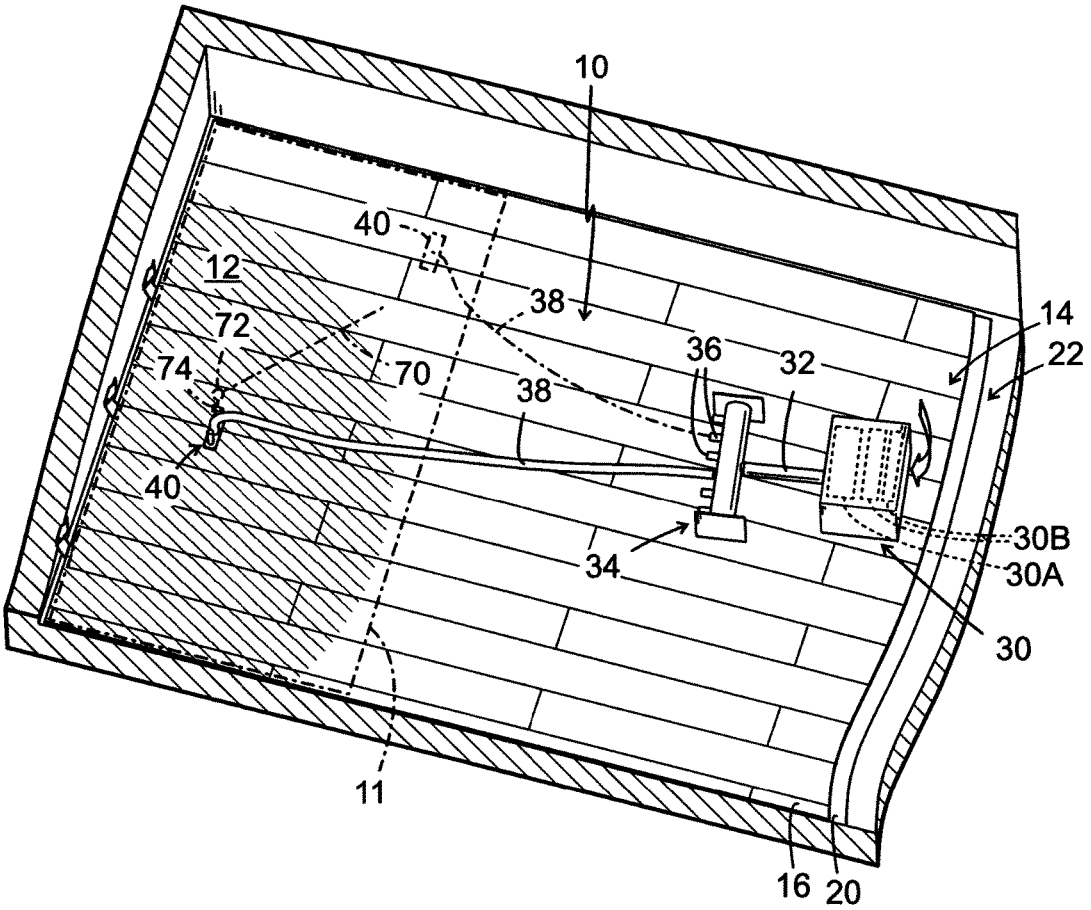
FIG. 1 is a diagrammatic broken-away oblique top view of an enclosure having a floor being dried by an arrangement according to the invention.

In FIG. 1, a floor 10, including a floating flooring 14, such as comprising a parquet surface layer 16 and having a water damage 12, is being dried by using an arrangement of the invention. In this context, "floor having a water damage" is to be broadly understood as the portions of the flooring, subfloor and adjoining structures that are susceptible for being dried by the method and arrangement according to the invention.

In the embodiment shown, the arrangement comprises an air conditioning device 30, a manifold 34 and an adapter 40 connected by tubing 32, 38.

The air conditioning device 30 is adapted for providing a conditioned airflow capable of drying the floor 10 in a manner to be later described. Device 30 comprises a blower or fan 30A and typically also one or more components 30B for further necessary air treatment such as heating and dehumidifying/drying the airflow to be forced through the arrangement via tubing 32, 38. In certain circumstances it may, however, be sufficient to use an unconditioned airflow. While the fan 30A typically will force the airflow by overpressure, it could conceivably also force the airflow by suction.

As diagrammatically shown in phantom in FIG. 1, the manifold 34 may be used in cases when there is a need to distribute the conditioned airflow to a plurality of adapters 40 through outlets 36, depending on the extent of the water damage.

Figure 2:
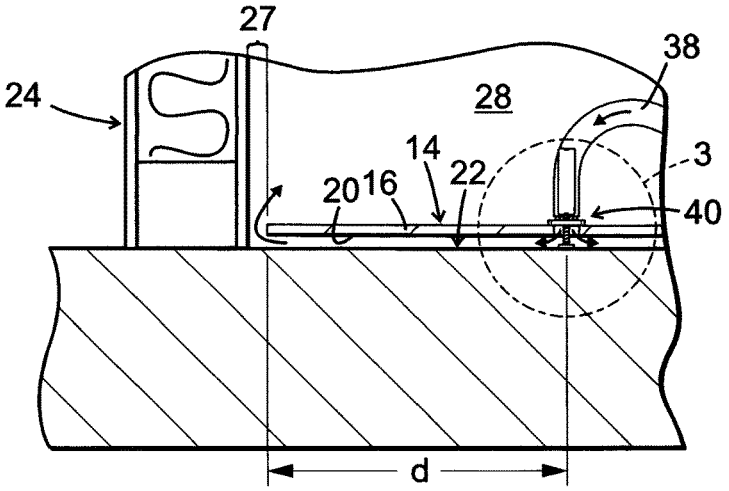
FIG. 2 is a broken-away sectional view showing an end portion of a floor being dried by an arrangement according to the invention.
Figure 3:
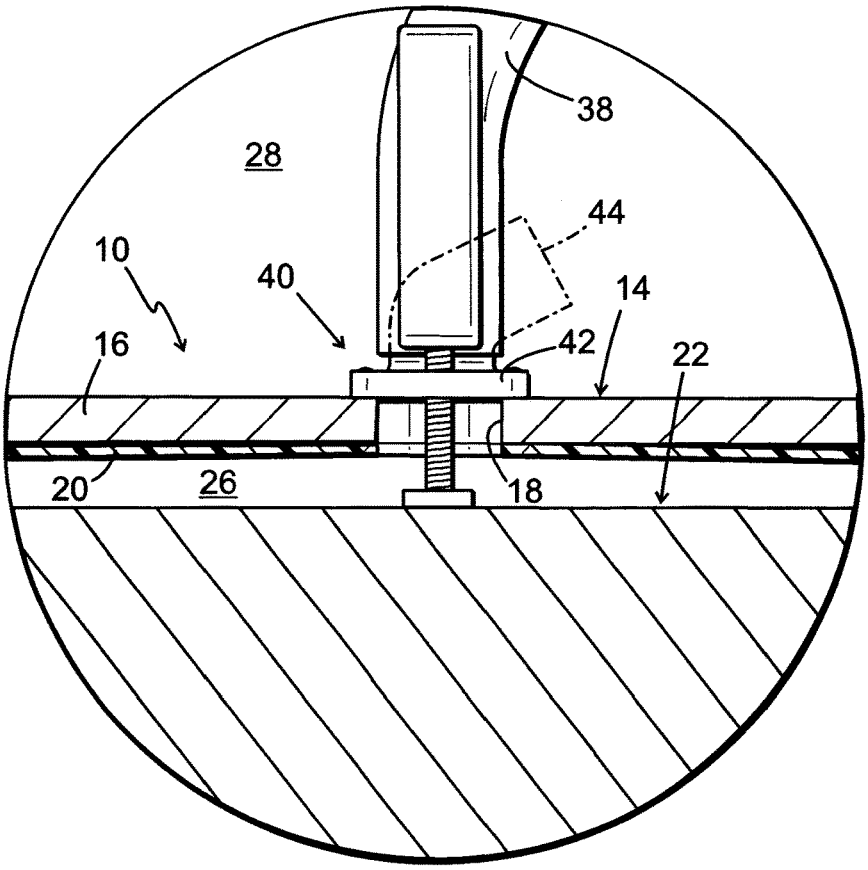
FIG. 3 is a view showing the encircled area 3 of FIG. 2 at a larger scale.
Figure 4:
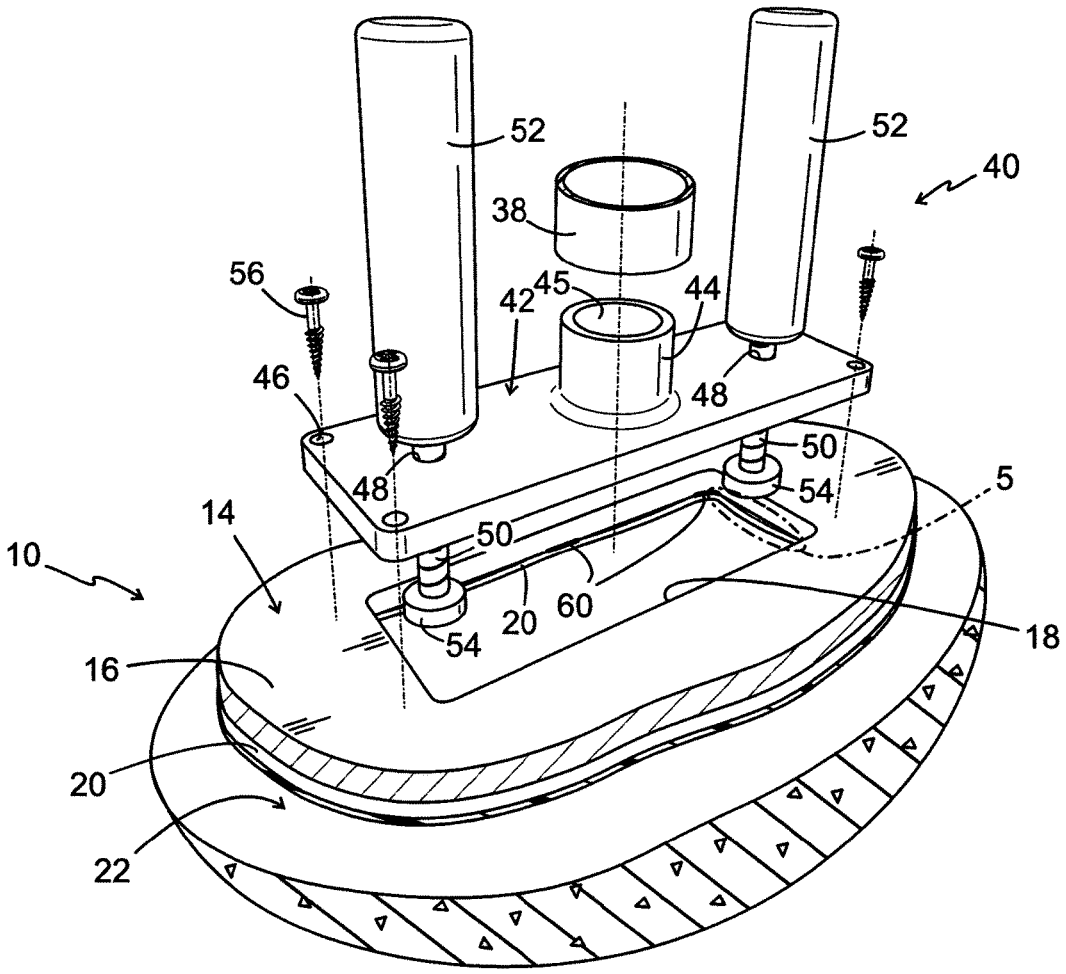
FIG. 4 is an exploded broken-away perspective view showing an adapter according to the invention and an underlying flooring-floor structure.

The adapter 40 is shown in in greater detail in FIGS. 2-4. With reference to FIG. 4, adapter 40 includes a base or base plate 42 having means including a pipe stud 44 with a throughbore 45 to be connected to an end of tubing 38 for guiding the airflow through the base plate 42. Pipe stud 44 needs not to extend perpendicularly from base plate 42, but can be oriented at any angle convenient for connection to the end of tubing 38 as illustrated in phantom in FIG. 3.

Base plate 42 is adapted to be sealingly attached to the flooring 14 around an opening 18 formed in the flooring 14 at and end portion 11 (FIG. 1) of the floor 10. In a typical case when the flooring 14 comprises a parquet surface layer 16, the opening 18 may be machined in the flooring 14 prior to the drying operation, for example by a router (not shown), to a generally rectangular shape as shown in FIG. 4.

In the embodiment of FIG. 4, the means for attaching the adapter to the flooring 14 comprise screws 56 to fasten the base plate through screw holes 46. However, other means for attachment are conceivable to the skilled person, such as releasable screw clamping means extending through the opening and engaging a bottom face of the flooring 14 (not shown).

The arrangement according to the invention further has an elevating device for elevating the above-mentioned end portion 11 of the flooring from a subfloor 22. In this context, "end portion" may be any lateral, longitudinal or other end portion of the flooring. In the embodiment of FIG. 4, the elevating device is incorporated in the adapter 40 and comprises a pair of pushing elements. Each pushing element includes a screw 50 having an external thread engaging an internal thread of a respective bore 48 in the base plate 42. Each screw 50 has a bottom pad 54 for engaging a subfloor 22, and a top handle 52 to be manually turned for pushing the adapter 40 and attached flooring 14 away from the subfloor 22, thereby creating a ventilating space 26 (FIG. 3) between flooring 14 and subfloor 22.

As diagrammatically indicated in FIG. 1, in order to be capable of manually operate the elevating device at a distance from the opening 18, the two handles 52 can be replaced (or supplemented) by a preferably telescopically extendable single rod 70 having a handle (not shown), a distal universal joint 72 and a socket 74 that is releasably connectable to either screw (or handle). Then, an operator does not need to stand in the vicinity of the opening 18 and unnecessarily load the flooring 14 with the weight of the operator when operating the elevating device. The operation is thereby also facilitated for the operator.

Figure 5:
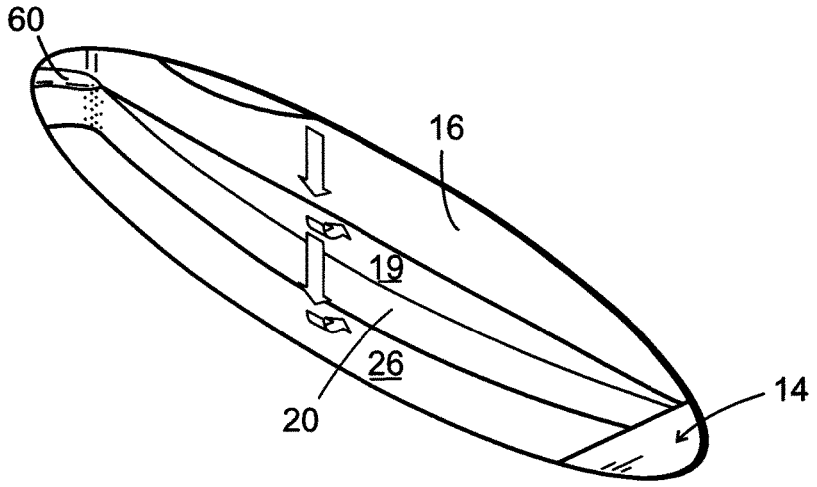
FIG. 5 is a view showing the enclosed area 5 of FIG. 4 at a larger scale.

In the embodiment shown, flooring 14, in addition to the relatively stiff surface layer 16, also has a relatively flexible subsurface layer 20. Such subsurface layer 20, that is often made of a synthetic foam, usually has the function of a resilient support for the surface layer 16. In order to allow a forced drying airflow also between the surface layer 16 and subsurface layer 20, top face of subsurface layer 20 can be intermittently attached, such as by gluing, to bottom face of surface layer 16 at patches 60 in the vicinity of the opening 18, as shown in FIGS. 4 and 5. As illustrated by arrows in FIG. 5, the forced airflow to the ventilating space 26 will then be able to enter also an additional ventilating space 19 between layers 16, 20 via gaps between adjacent patches 60.

Figure 6:
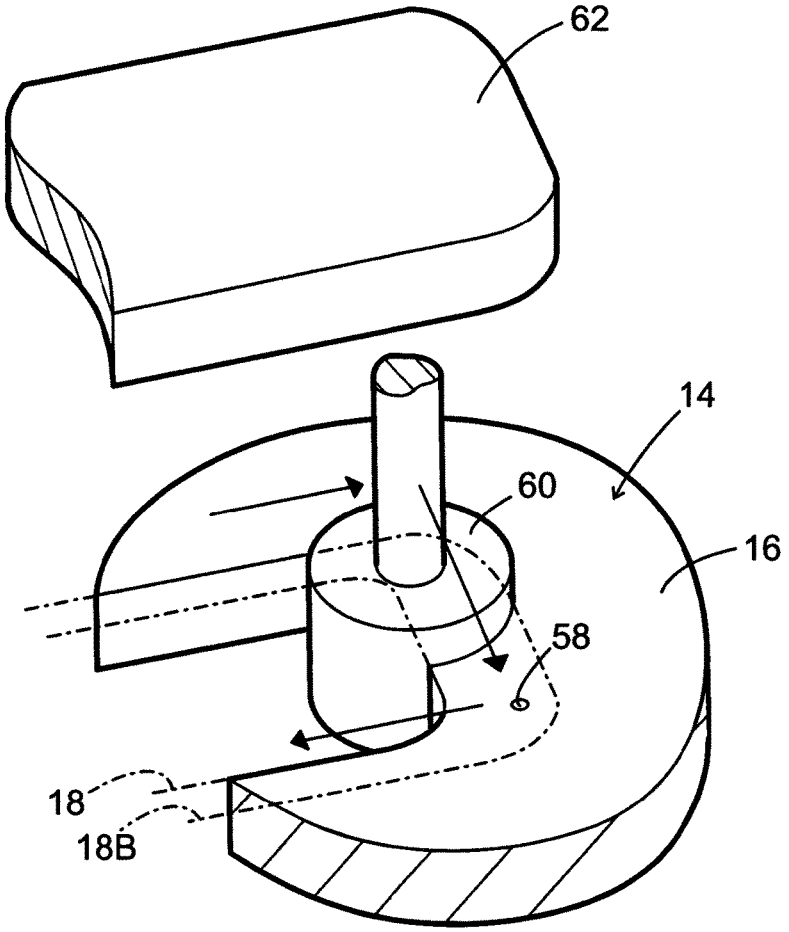
FIG. 6 is a diagrammatic broken-away oblique top view of a flooring being provided with an enlarged opening and a closure after a drying operation.

To restore the flooring 14 when the drying operation is completed, the opening 60 can be closed in a manner known per se by a correspondingly shaped lid of flooring material. In case adapter base plate 42 was screwed to flooring 14, opening 18 may need to be enlarged to remove screw holes 58 (FIG. 6) left in the flooring 14. As diagrammatically shown in FIG. 6, an accordingly enlarged opening 18B can be formed in surface layer 16, having a perimeter shaped with great precision by using a template (not shown) capable of guiding a routing tool 60 around the enlarged opening 18B to be formed thereby. A lid 62 shaped in correspondence with the enlarged opening 18B can be used to close the enlarged opening and seal it by gluing.

Figure 7:
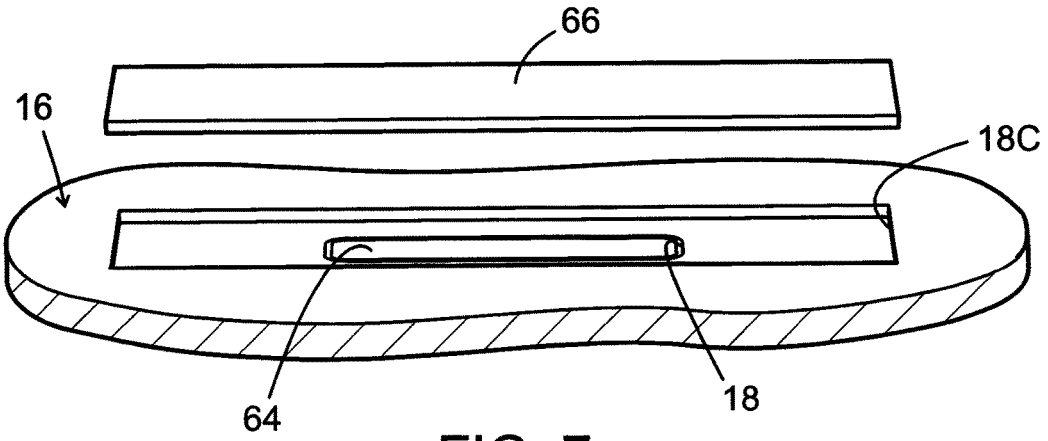
FIG. 7 is an exploded lateral broken-away perspective view of a flooring being provided with an alternatively enlarged top opening and a closure after a drying operation.

The closing of the opening 18 may also be made by other methods, known per se. With reference to FIG. 7, one such other method to obtain a high-finish closure, may be to position a bottom support pad or block 64, roughly corresponding to the outline of the opening 18, in the opening 18, and then remove only a top layer of a larger area 18C, e.g. by routing, around the opening at a thickness of a thin finishing piece, element or veneer 66 to be carefully inserted and glued into the larger area 18C, supported by the pad or block 64. When convenient, of course also a full new flooring element could replace a full flooring element containing the opening (not shown).

The foregoing detailed description is given primarily for clearness of understanding and no unnecessary limitations are to be understood therefrom. Modifications will become obvious to those skilled in the art upon reading this disclosure and may be made without departing from the spirit of the invention or the scope of the appended claims.

The invention claimed is:

1. A method of drying a water damaged floor having a flooring and a subfloor, comprising an opening in an end portion of the flooring, the opening forming through the flooring and having a perimeter, the method comprising:

elevating the end portion of the flooring from the subfloor for creating therebetween a ventilating space having a wedge-shaped cross section and for creating an air passage at an edge of the end portion of the flooring; and creating and forcing an airflow from a surrounding space through the opening into the ventilating space, through the air passage and back to the surrounding space.

2. The method of claim 1, further comprising lifting the flooring by pushing the flooring away from the subfloor.

3. The method of claim 2, further comprising pushing by force acting through said opening.

4. The method of claim 1, wherein the flooring comprises a stiff surface layer and a flexible subsurface layer, comprised by gluing the subsurface layer to the surface layer intermittently around the perimeter of said opening for allowing airflow also into a space between the surface layer and the subsurface layer.

5. The method of claim 1, further comprising enlarging the opening after a completion of said drying and closing the resulting enlarged opening by a correspondingly shaped lid.

6. The method of claim 1, further comprising enlarging a top portion of the opening after a completion of said drying and closing the resulting enlarged opening by a correspondingly shaped piece or element.

7. The method of claim 1, further comprising conditioning the airflow.

8. An arrangement for performing the method of claim 1, comprising:

a blower for creating and forcing said airflow;

tubing for communicating the airflow between said a blower for forcing the airflow and said opening;

an adapter for connecting the tubing to the opening; and an elevating device for lifting said end portion of the flooring from the subfloor.

9. The arrangement of claim 8, further comprising an air conditioner configured to condition the airflow.

10. The arrangement of claim 8, further comprising a manifold between the blower and said opening.

11. The arrangement of claim 8, wherein the elevating device comprises a pushing mechanism to be inserted in said opening for engagement with the flooring and the subfloor.

12. The arrangement of claim 11, wherein the pushing mechanism being integrated with said adapter.

13. The arrangement of claim 12, wherein the pushing mechanism comprises a screw mechanism.

14. A lid to be used for closing an opening used in a method of claim 1.

15. An adapter for use in the arrangement according to claim 12, comprising:

a base having a bore through the base;

means in the base for connecting an end portion of said tubing to the bore;

a pushing mechanism; and at least one fastener that is configured to attach the base to said flooring.

16. The adapter of claim 15, wherein the means for connection comprise a pipe stud.

17. The adapter of claim 15, further comprising a rod having a universal joint, wherein a distal end of the rod is releasably connectable to a screw or handle in the pushing mechanism.

* * * * *